United States Patent [19]

England et al.

[11] Patent Number: 4,637,475

[45] Date of Patent: Jan. 20, 1987

[54] IN-THE-HOLE DRILL

[75] Inventors: John R. England; Richard L. Riach, both of Sudbury, Canada

[73] Assignee: Inco Limited, Toronto, Canada

[21] Appl. No.: 572,831

[22] Filed: Jan. 23, 1984

[30] Foreign Application Priority Data

Jan. 5, 1984 [CA] Canada ..... 444715

[51] Int. Cl.[4] ..... E21B 15/04

[52] U.S. Cl. ..... 173/43; 173/28; 173/31

[58] Field of Search ..... 173/22, 23, 28, 31, 173/38, 141, 152, 37, 42, 43, 35, 45, 32, 33, 34, 44; 175/203; 92/52, 53; 299/33; 408/234, 236; 248/644, 659

[56] References Cited

U.S. PATENT DOCUMENTS

| | | | |
|---|---|---|---|
| 761,408 | 5/1904 | Royer | 248/644 |
| 2,811,335 | 10/1957 | Fletcher et al. | 173/23 |
| 2,870,994 | 1/1959 | Klapka | 173/34 |
| 2,910,049 | 10/1959 | Calder | 92/53 |
| 3,181,624 | 5/1965 | Lindberg | 173/43 |
| 3,357,502 | 12/1967 | Elliott | 173/28 |
| 3,399,734 | 9/1968 | Folinsbee | 173/34 |
| 3,452,829 | 7/1969 | Smith | 173/28 |
| 3,529,680 | 9/1970 | Nardone et al. | 173/23 |
| 3,800,887 | 4/1974 | West | 173/163 |
| 3,814,194 | 6/1974 | Reich et al. | 173/28 |
| 3,917,005 | 11/1975 | Cannon et al. | 173/23 |
| 4,303,130 | 12/1981 | Bonca | 173/23 |
| 4,336,840 | 6/1982 | Bailey | 173/28 |
| 4,398,850 | 8/1983 | Talvensaari | 405/261 |

FOREIGN PATENT DOCUMENTS

| | | |
|---|---|---|
| 2475110 | 8/1981 | France . |
| 1101692 | 1/1968 | United Kingdom . |

OTHER PUBLICATIONS

CD-90/CD-360 Down-The-Hole Drill Rigs, Continuous Mining Systems Limited CMS Sells Productivity, pp. 54–55, Canadian Mining Journal, Jan. 1985.

New Machines Designed for Bulk Mining, p. 56, Engineering & Mining Journal, Dec. 1984.

Inco's Copper Cliff North Mine—Technology Testing Ground for Productivity Gains, The Northern Miner, Aug. 15, 1985.

Glueckauf, vol. 117, No. 21, Nov. 1981, pp. 1429–1431, Bochum, (DE) G. Hinderfeld: "Ein Bohrwagen als Transport—und Rusthilfe zum Herstellen von Gasbohrlochern".

"Technology-Mining Seeks Modernization" by Daniel F. Cuff, New York Times, Feb. 20, 1986, p. D2.

"New Ideas for Mining at Inco", by M. P. Sassos, Engineering and Mining Journal, Jun. 1986, cover and pp. 36–39 and 41.

"Underground Mining Equipment: Flexibility and Productivity are Still Watchwords", by R. A. Thomas, *Engineering and Mining Journal*—Jun. 1978, p. 69.

"Percussive Blasthole Drilling" *SME Mining Engineering Handbook,* ed. by A. B. Cummins and I. A. Given, vol. 1, pp. 11-42-11-56, The American Institute of Mining, Metallurgical and Petroleum Engineers, Inc. N.Y., NY 1973.

"Drill Bits" and Drilling Machines pp. 46–47 and 50–51, *Mining Methods & Equipment,* by K. S. Stout, McGraw-Hill, Inc. N.Y., NY 1980.

*Primary Examiner*—Donald R. Schran

*Assistant Examiner*—James L. Wolfe

*Attorney, Agent, or Firm*—Edward A. Steen; Raymond J. Kenny

[57] ABSTRACT

A compact, easily disassembled, minimum headroom drilling unit is disclosed. The drill, especially useful for newly developed vertical retreat mining methods, drills at compound angles from the vertical and horizontal directions. Low headroom is achieved by the employment of a double acting hydraulic cylinder.

10 Claims, 11 Drawing Figures

IN-THE-HOLE DRILL

TECHNICAL FIELD

The instant invention relates to drilling in general and more particularly to a hydraulically powered drill and a double acting cylinder therefor especially adapted for drilling holes underground in confined areas.

BACKGROUND ART

A highly efficient and safer method of bulk mining entitled Vertical Retreat Mining ("VRM") has been recently developed to more expeditiously mine ore from underground mines. In brief, in order to continue to work an underground excavation, large diameter blast holes are drilled into the floor of an upper stope (or drift) vertically disposed above a lower stope. The stopes may be separated by up to 750 feet (228.6 meters). These blast holes of various depths are drilled in predetermined patterns and filled with the appropriate explosive in order to loosen the ore and rock disposed between the two levels for subsequent removal and treatment.

Currently, there are a number of in-the-hole ("ITH") drills that accomplish the above task. However, they have a number of drawbacks that oftentimes impede efficient drilling. Current machines require about 12½ feet (3.8 m) of back height to drill a vertical hole with a standard 5 foot (1.5 m) drill rod. The drive head is usually vertically driven by a long double ended hydraulic cylinder; a ganged triple hydraulic cylinder arrangement with one central cylinder flanked by two side cylinders; or a cumbersome chain and sprocket arrangement. The masts on such machines require so much height that it is impossible to drill in low back height areas. Accordingly, even when such was unnecessary a stope would have to be enlarged to at least twelve and a half feet high just to accomodate the ITH drill.

Similarly, these machines, due to their size, and physical construction, could not easily be transported through small openings. Rather than spending time, money and manpower on the productive business of mining and recovering ore, valuable time and money is wasted simply in making areas large enough to accomodate these drills. Moreover, due to their construction, it was difficult or impossible to drill and align holes at various angles due to the inability of the drills to remain stable. The drills would tend to swing and bounce thereby making angled drilling quite a difficult undertaking. Moreover, most machines do not allow the application of initially high down pressure (about 2000 lbs. [8896N]) on the bit. Initial pressures of this magnitude tend to cause current machines to lift and buck as a result of the reactions to the percussive hammer blows within the hole. This phenomenon makes drill string alignment difficult. The machines, although bulky, are not heavy enough to absorb the shock generated. Rather, current machines must commence drilling with a relatively low initial loading while relying on the dead weight of the increasingly longer drill string. Inasmuch as the average weight of a five foot rod is about 80 lbs/rod (36.2 kg/rod), about twenty-five rods are necessary in order to allow the hammer to operate efficiently at 2000 lbs.

SUMMARY THE INVENTION

Accordingly, there is provided a compact, modular, easily disassembled, self-propelled, minimum headroom, underground blast hole drilling unit requiring a minimum size drift relative to a standard five foot drill rod and feed. The unit can drill at compound angles from the vertical to borizontal directions. The drill may be set for down-hole drilling, up-hole drilling and for angles in between. Low headroom is achieved by the employment of a double acting hydraulic cylinder.

PREFFERED MODE FOR CARRYING OUT THE INVENTION

Figure 1:
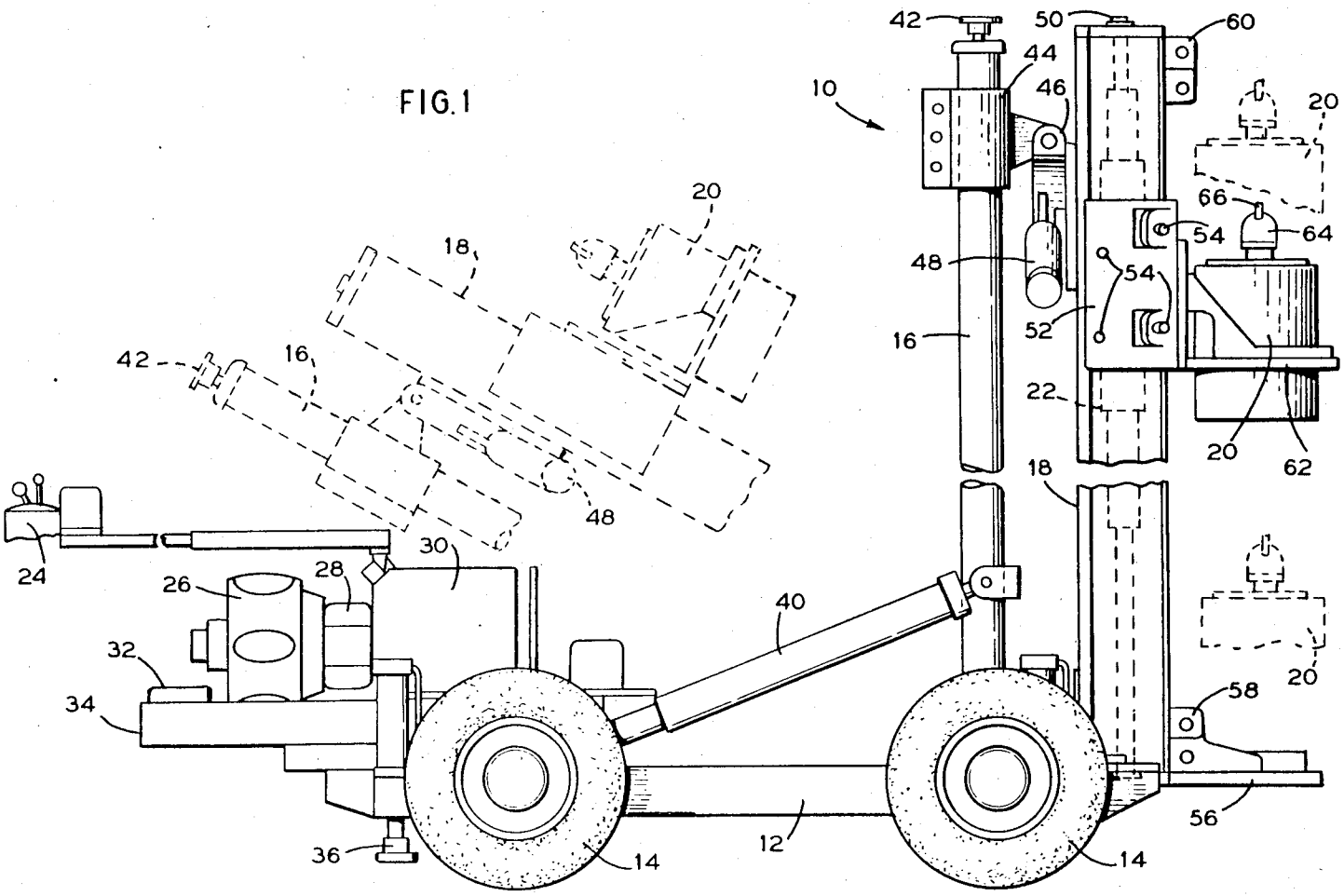
FIG. 1 is an elevation of an embodiment of the invention.
Figure 2:
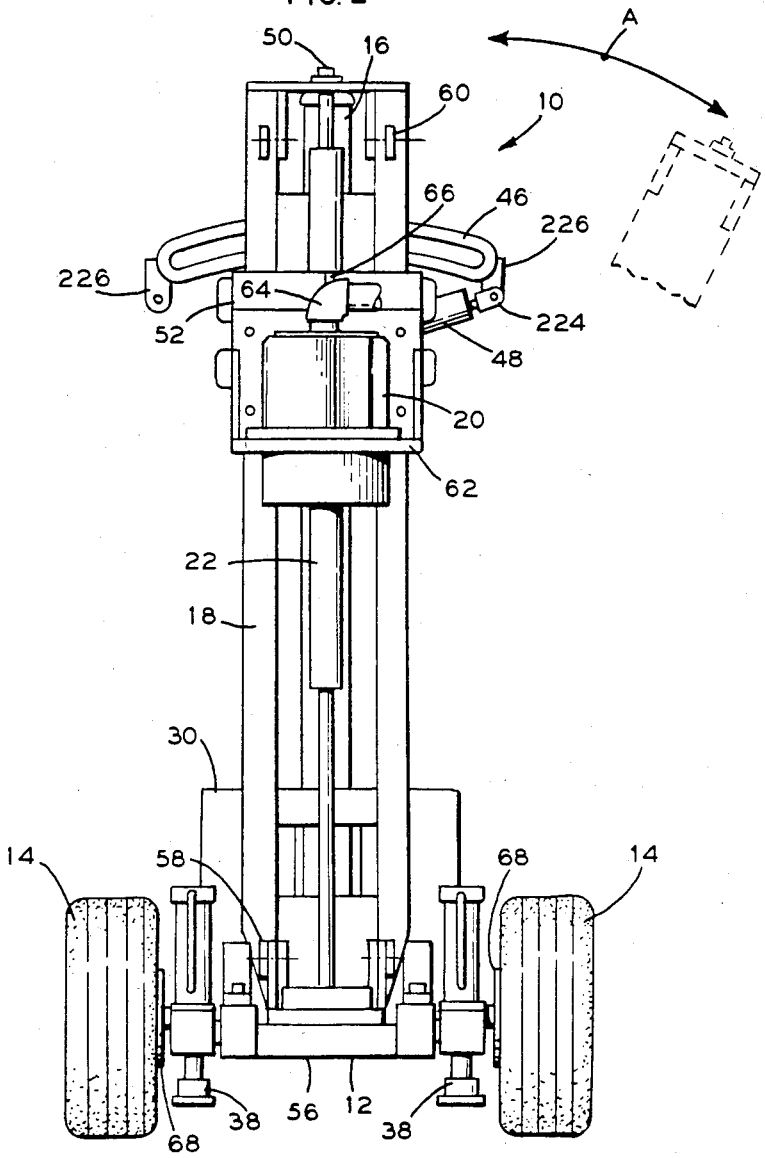
FIG. 2 is a front view of an embodiment of the invention.

Referring to FIGS. 1 and 2, there is shown a compact, mobile, in-the-hole (ITH) drill 10 shown in side and front views respectively. Inasmuch as the drill 10 utilizes hydraulic fluids and pneumatic power, the various feedlines and couplings are not shown for purposes of clarity. However, from the ensuing discussion, one skilled in the art should have no difficulty visualizing and conceptualizing the various lines, functions, and associated connecting hardware.

Turning now to FIGS. 1 and 2, the drill 10 includes frame 12, tires 14, mast support column 16, drill mast 18, jacks 36 and 38 and a source of power 26. The source of power 26, which in this embodiment is an electric or diesel or air motor, is directly connected to hydraulic pump 28 which, in turn, communicates with oil tank 30. The entire assembly consisting of the air motor 26, the pump drive 28, the oil tank 30 and a lubricator tank 32 are mounted on skid 34 for easy disassembly from the drill 10. Controls 24 enable an operator to control the drill 10.

The mast support column 16 may be placed in the upright position or in an intermediate position by means of two tilt cylinders 40 (only one is shown in FIG. 1). The cylinders 40 are attached to the column 16 and the frame 12 by suitable means.

Figure 8:
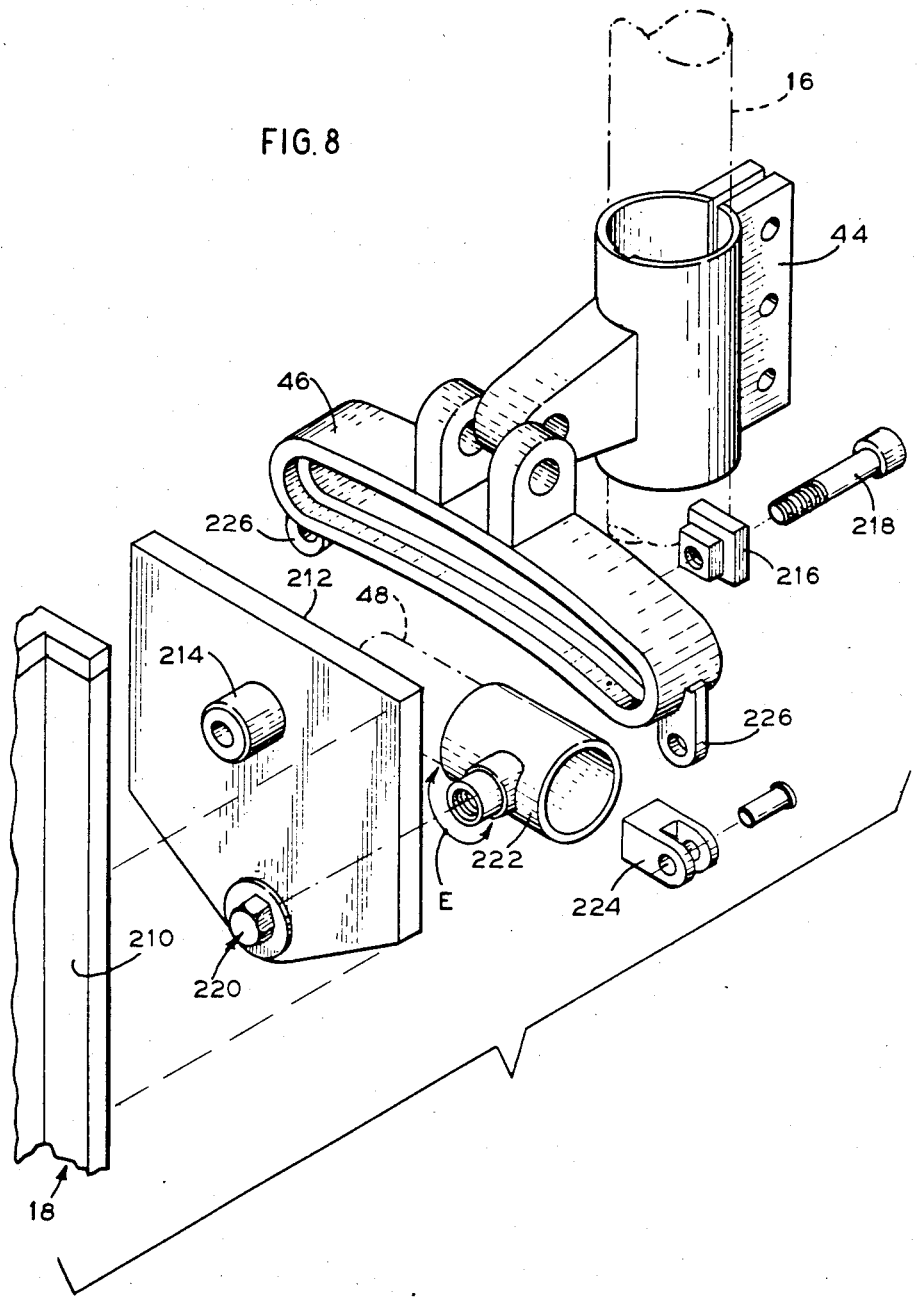
FIG. 8 is a detailed view of a feature of the invention.

The drill mast 18 is permitted to swing through arc "A" by means of tilt cylinder 48. Column bracket 44, affixed to the column 16, includes yoke 46. Brackets 226, extending from the end of the yoke 46 are connected to clevis 224. Referring briefly to FIG. 8 it may be observed that plate 212, affixed to the mast 18, includes bushing 214 and bolt assembly 220. The bushing 214 is registered with nut 216. Bolt 218 is threaded into the nut 216 through the yoke 46. Swivel 222 is rotatably attached through arc "E" to the assembly 220. The tilt cylinder 48 (partly shown in phantom in FIG. 8) is circumscribed by the swivel 222. Clevis 224 is affixed to the pushrod of the tilt cylinder 48 and affiliated with bracket 226. Numeral 210 represents a flange in the drill mast 18.

FIG. 2 depicts the tilt cylinder 48 on the right side of the drill 10. In the embodiment shown, if the arc A desired is to be on the left side of the drill 10, the tilt cylinder 48 is disassociated from the right bracket 226, swung down and around (via swivel 222) and then attached to the left bracket 226 of the yoke 46.

Figure 9:
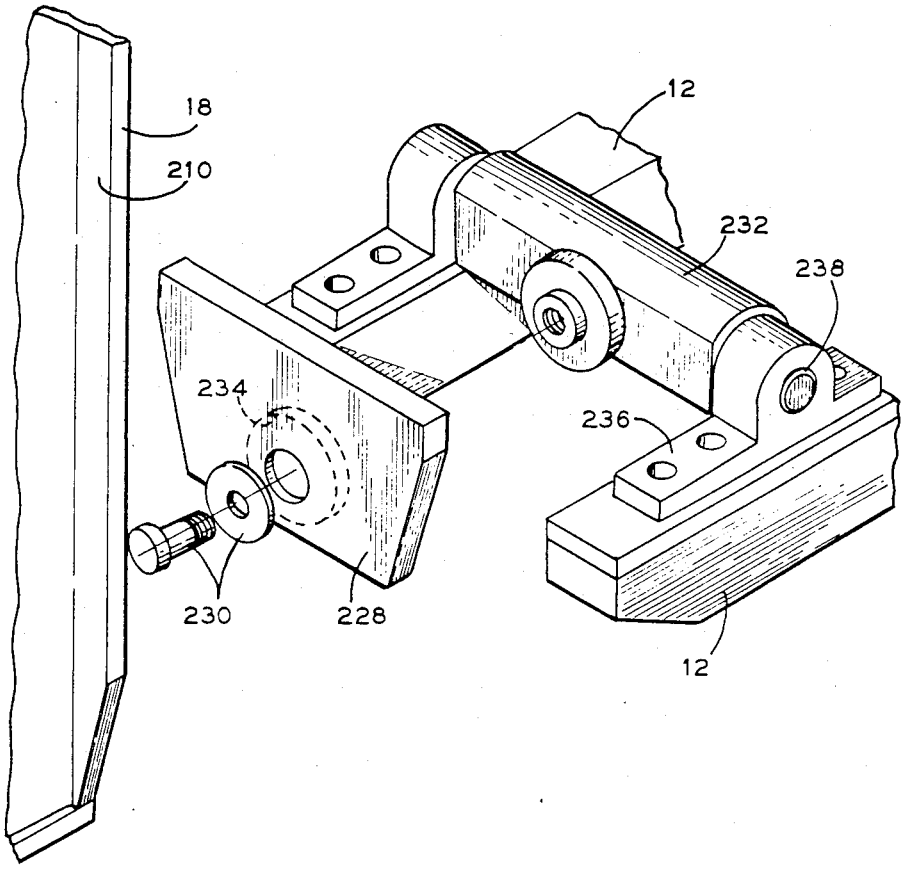
FIG. 9 is a detailed view of a feature of the invention.

Turning to FIG. 9, it may be observed that the pivoting action of the mast 18 occurs due to plate 228 and bolt 230 assembly pivoting about trunnion 232. The plate 228, attached to the bottom of the mast 18, includes depression 234 which accomodates the head of the trunnion 232. The trunnion 232 acts in a dual manner. It permits the frame 18 (and the column 16) to come up to the vertical (via bushings 238 in blocks 236), while simultaneously allowing the mast 18 to pivot within the predetermined arc A.

Returning to FIGS. 1 and 2, cam roller carrier 52 which is attached to rotary drive 20 is slidably mounted on the drill mast 18 to enable the operator to raise or lower a drill string (not shown) connected to the rotary drive 20. The carrier 52 is mounted with rollers 54. Double acting cylinder 22, affixed to the carrier 52, raises and lowers the rotary drive 20. Worktable 56, which is hinged to bracket 58, may be swung up or down, depending on the circumstances, to hold tools and to enable the operator to break the drill string during operation.

Due to the design of the drill 10, the rotary drive 20 may be inverted to drill upwardly. In such an event, drive bracket 62 is rotated 180 degrees. Moreover, the worktable 56 may be unhinged from bracket 58 and attached to bracket 60 to provide a hinged work surface when upward drilling is desired.

The worktable 56 is movably attached to the bottom of the mast 18 and may be flipped up or flipped down at will. The worktable 56 supports the string of drill rods when the rods are either being added or removed. It also provides a mounting plate for the wrenches used to break the joints on the drill rods and for the guide bushings used when starting a new hole. The advantages of using a movable worktable are as follows: When a new hole is started, a casing pipe must be installed at the top of the hole to prevent broken lock from falling in. To install this casing, the mast 18 would otherwise have to be tipped back to allow access to the hole. This would require the hole to be realigned and the drill set up again every time this is done. However, by flipping the worktable 56 up, the casing may be installed without disturbing the position of the mast 18 or the drill 10.

Hydraulic jacks 36 and 38 serve to secure the drill 10 with the ground during drilling operations. By the same token, jack 42 may be placed against the roof of the excavation to further stabilize the drill 10. As can be seen by FIGS. 1 and 2, the rotary drive 20 may be raised or lowered and tilted both parallel to the frame 12 and perpendicular to it.

Due to the difficulties posed by underground travel, it has been determined that it is most expeditious to utilize four independently driven wheels 14. Treads tend to gum up in the hostile, wet environments found in underground excavations. Rather, each wheel 14 is associsted with its own hydraulic wheel motor 68. In this fashion, the operator can cause the drill 10 to be propelled with outstanding traction. Moreover, in the event that an individual wheel motor 68 fails, the remaining driven wheels 14 can be still utilized.

Figure 4A:
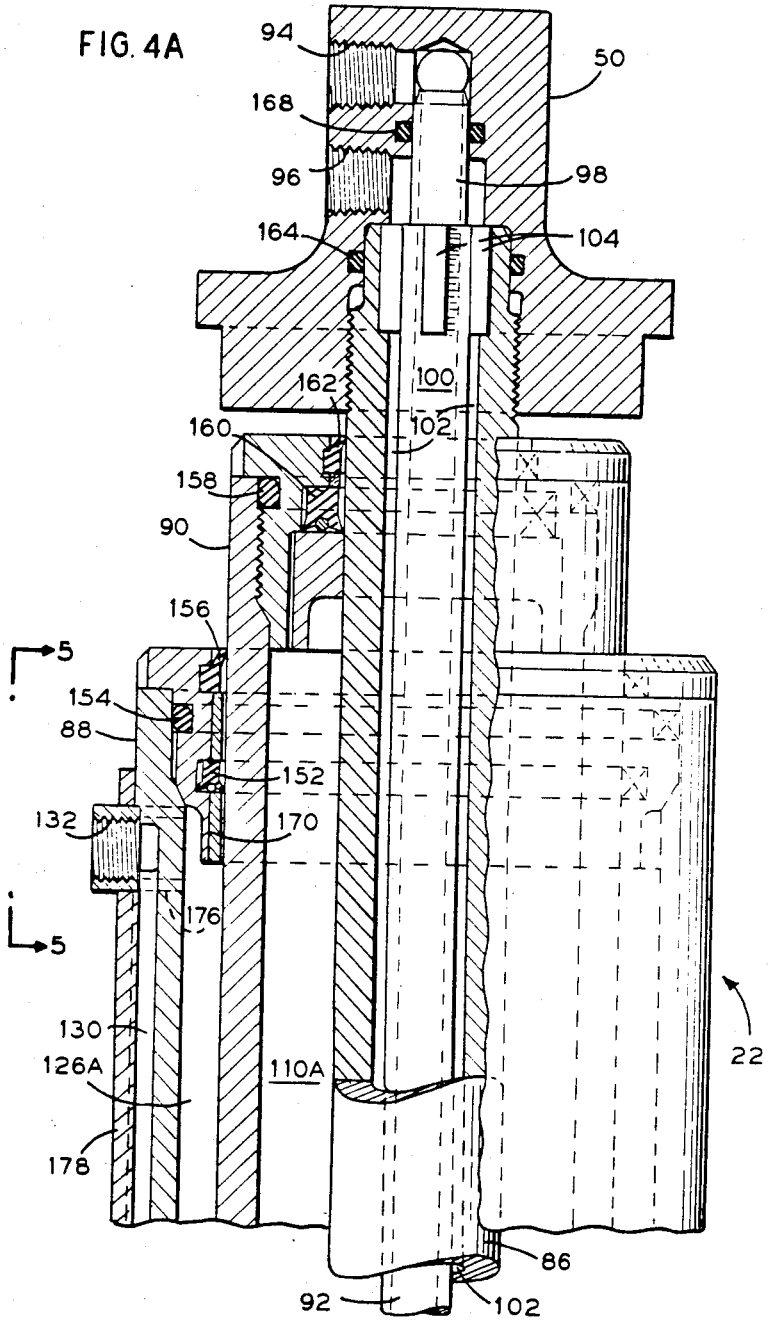
FIGS. 4A and 4B are cross-sectional views of a feature of the invention.
Figure 4B:
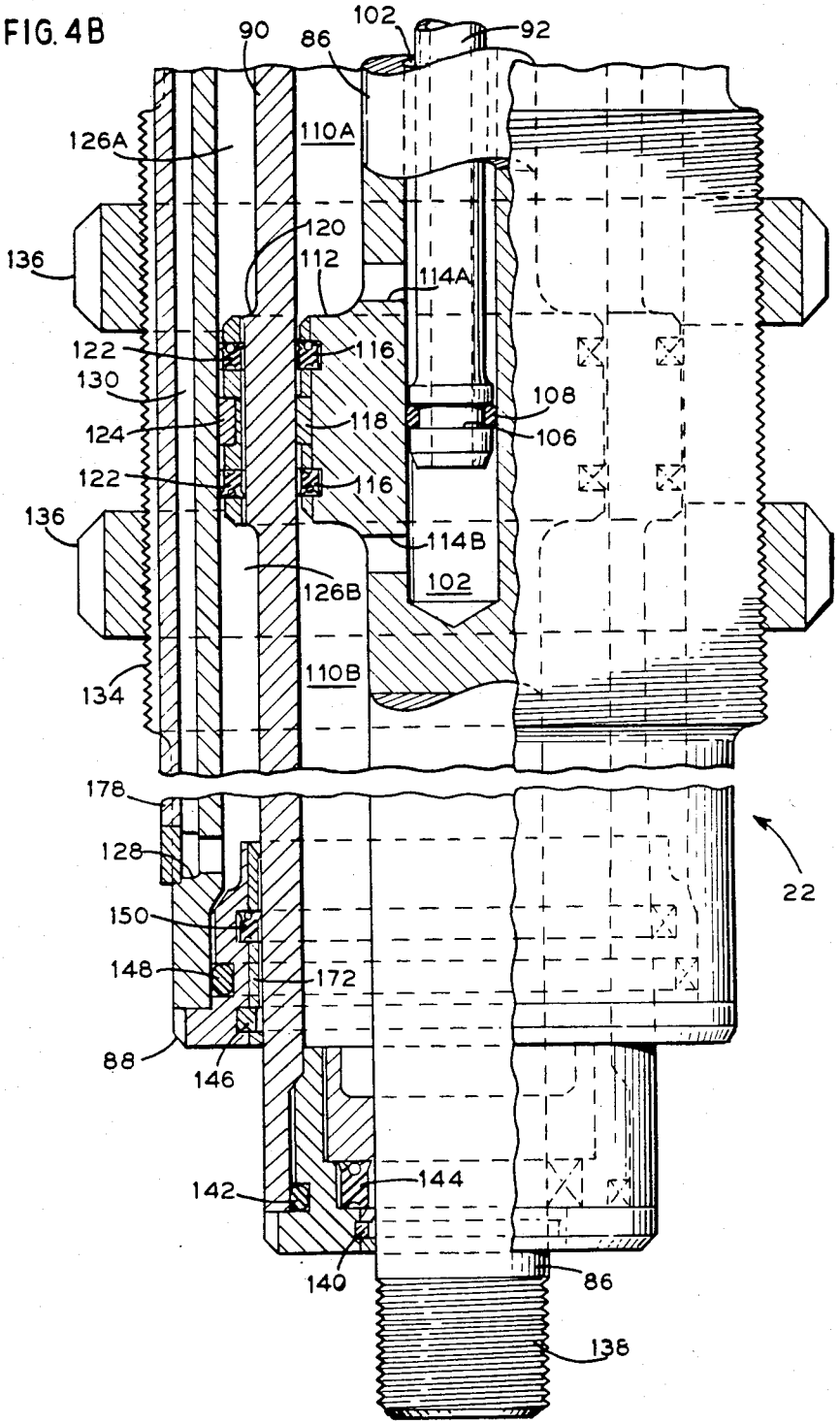
Figure 5:
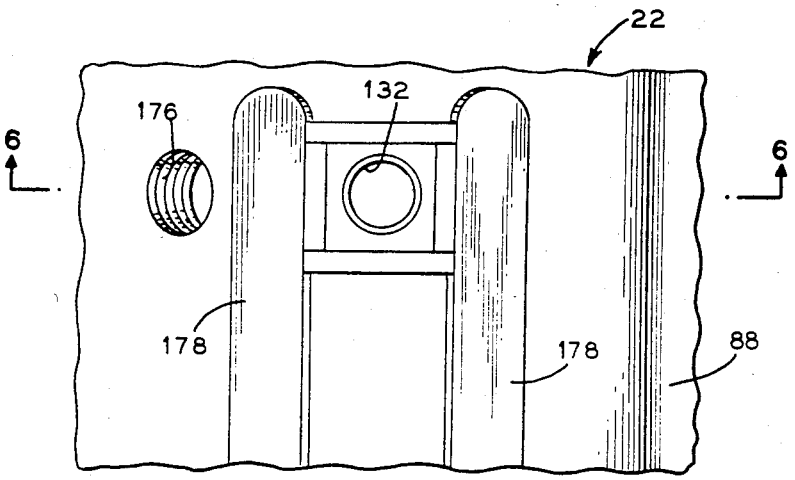
FIG. 5 is a view taken along line 5—5 in FIG. 4A.
Figure 6:
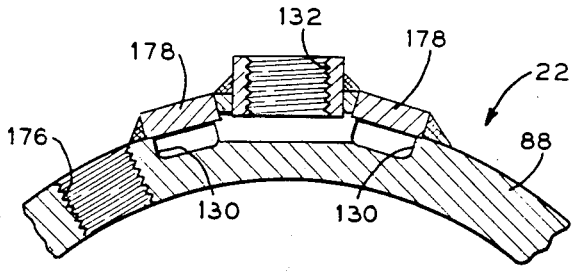
FIG. 6 is a view taken along line 6—6 in FIG. 5.

In order to appreciate the drill 10 more fully, a number of the features are shown in greater detail. As was alluded to previously, prior in-the-hole drills have suffered from a number of shortcomings. Designed to overcome these problems, the instant drill 10 has utilized a number of novel components. Double acting cylinder 22, which is shown in greater detail in FIGS. 4*a* and 4*b*, raises and lowers the rotary drive 20. By applying pressure either in the upward or downward direction, an operator can control the pressure on the drill bit within the hole very precisely. This precise control allows for optimum drilling rates. In addition, longer bit life is achieved. As was stated previously, other ITH machines utilize a chain drive system for raising and lowering the feedhead. Because of this type of feed system, down pressure could not always be applied. Therefore, the drill had to be drilled into the ground at least about 100 feet (30.5 m) before satisfactory bit pressure was approached by the cumulative weight of the rods. This method reduces bit life.

The cylinder 22, which is mounted in tension within the mast 18, is supported by cap 50 and a nut (not shown) disposed in the base of the frame 18 and around threaded section 138. The cylinder 22 must be placed in tension; otherwise due to the severe loadings experienced, the cylinder 22 would buckle.

Figure 3:
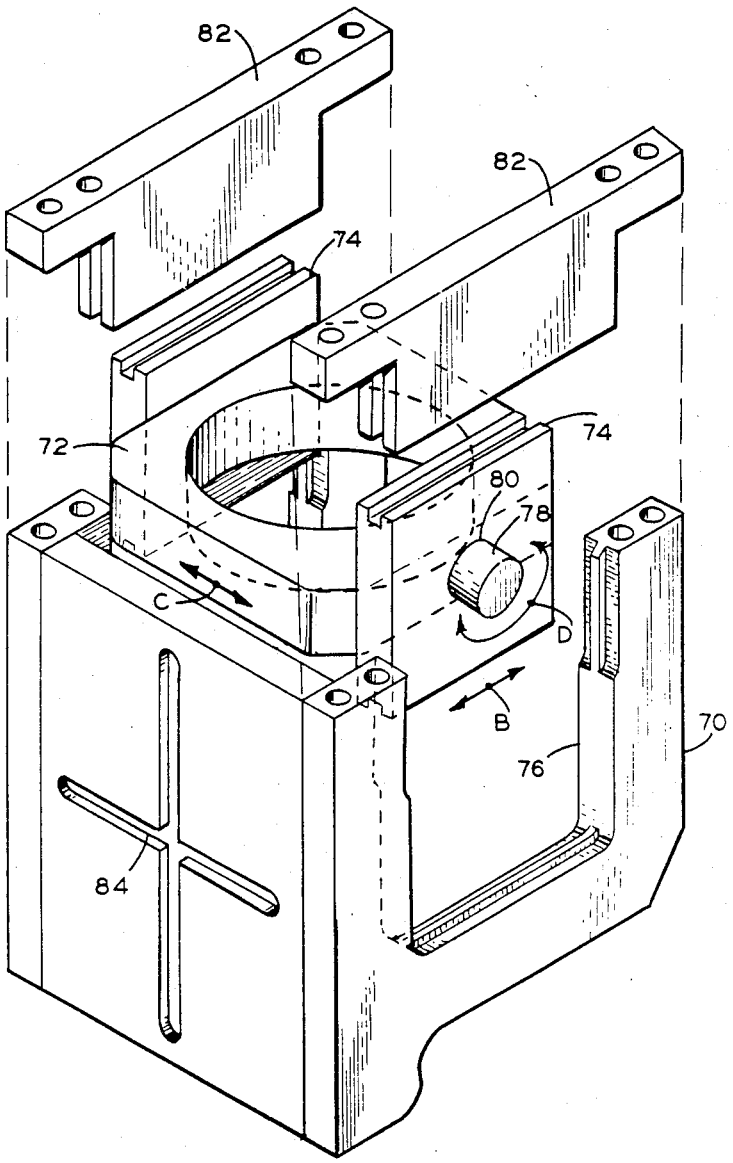
FIG. 3 is a detailed view of a feature of the invention.
Figure 10:
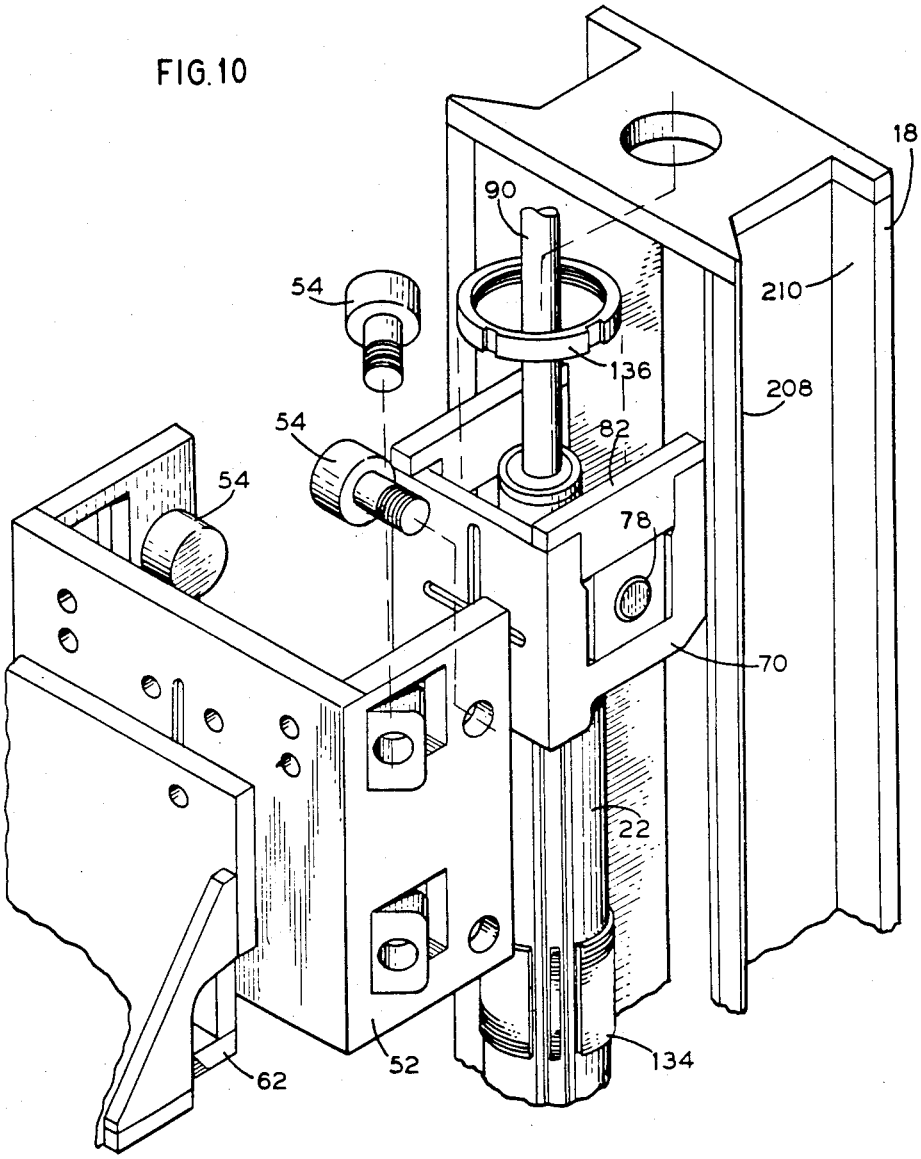
FIG. 10 is a detailed view of a feature of the invention.

Turning to FIGS. 3 and 10, it may be observed that trunnion 72, circumscribing the cylinder 22, is free to move in three dimensions ss shown by directional arrows "B", "C" and "D". As a consequence, the stresses and thrust loads experienced by the feed cylinder are substantially reduced. The trunnion 72, acting as a gimbal mount, includes two pins 78 which are inserted through bores 80 of blocks 74. The trunnion 72 is free to rotate in direction D. The blocks 74 are disposed within opening 76 of the bracket 70 and travel back and forth in directions B and C. Retainers 82 hold the entire assembly in place. Threaded rings 136, on threaded portion 134 of the cylinder 22, are tightened onto trunnion 72. In FIG. 10, the carrier 52 is registered against the bracket 70. The carrier 52 includes rollers 54 which fit into flanges 208 and 210 of the mast 18. The drive bracket 62, which holds the drive 20, is rotatably attached to the carrier 52. Although key 84 is shown, other rotatable mounting methods may be employed as well.

The trunnion 72 is used to secure the feed cylinder 22 to the carrier 52 in order to move the drive head 20 up and down. Since the feed cylinder 22 is unable to withstand any appreciable side loading, the trunnion 72 must allow for stress relief. The design of the trunnion 72 is such that it allows a limited amount of travel in the side to side (C) direction, forward and rear (B) direction, and it also reduces any rotational forces (D) applied to the cylinder 22. It is through the use of this trunnion 72 that longer cylinder 22 seal and wear bushing life may be achieved.

The mast 18 is manufactured from heavy form plate and welded together to form a rigid box frame. The heavy material makes the mast 18 a very rigid unit so that there is little flexing and movement during drilling. This lack of flexing helps to provide for a straighter, more accurate hole. In addition to the heavy mast 18, the rollers 54 are used to help improve drill accuracy. In most other drills, the drive head carrier moves up and down on metal to metal wearer plates. After drilling for a period of time, the plates begin to wear. The head then begins to shift and drilling accuracy is severely reduced. By using the cam rollers 54, the head 20 moves up and down on ball bearings and there is only minimal amount of wear after a great length of time. As can be seen, the rollers 54 fit into the flanges 208 and 210 of the mast 18 to allow freedom of movement. In addition, the power to move the head up and down is reduced because of the lower friction posed by the rollers 54.

The drill 10 is propelled by the tires 14. In the past, the majority of rock drilling equipment has been manufactured with tracked tread carriers. The instant drill 10 uses four independently driven hydraulic rubber tires. Each wheel 14 has its own wheel motor 68 to individually drive the tire. Each wheel motor 68 is completely self-contained and sealed. Mud, water and grit cannot get inside to wear out the bearings and other components, as is the case with tracked vehicles, especially if the drill 10 is parked in drilling slimes for extended periods of time. Accordingly, this embodiment results in almost no maintenance. Moreover, should a wheel motor 68 stop functioning for whatever reason, it can be quickly isolated allowing the unit 10 to still be mobile on the remaining three wheel motors. In addition, the wheels can be made to free-wheel for rapid travel behind other equipment.

The entire wheel motor 68, tire 14 and stabilizer jack unit 36 and 38 can be completely removed for hoisting into a work area. In the embodiment shown, the entire motive and power combination 26, 28, 30 and 32 is mounted on the power pack skid 34. The air motor 26 is directly coupled to the pump drive 28 which in turn is connected to the oil tank 30. These units are commercially available and require no further discussion. However, it should be understood that the air-powered power unit provides pressure to the hydraulic lines that will go to the various components on the unit. By deploying the power units on the skid 34, the entire skid 34 may be removed for drill 10 transportation through narrow openings. Indeed, the mast 18, column 16 and bracket 62, as well as the entire modular drill 10, may be easily disassembled, transported to a small work area, and then reassembled.

FIGS. 4A, 4B, 5 and 6 depict various views of the double-acting cylinder 22. The cylinder 22 is unique in that it allows for the same displacement at both ends of central rod 86. Instead of using a difficult-to-maintain chain and sprocket mechanism or a triple ganged hydraulic cylinder arrangement, the instant invention utilizes a single, double-acting cylinder 22 which, due to its construction, allows for a relatively short stroke thereby allowing for a small roof headroom area.

The cylinder 22 includes the central rod 86 which is affixed to the base of the mast 18 via the threaded section 138. Cap 50 affixes the upper portion of the cylinder 22 to the mast 18. A central void 102 extends through the rod 86. Disposed within the void 102 is hollow cylinder inner tube 92. The inner tube 92, having a central void 100 and holding fins 104, extends via extension 98 without the rod 86 and is affixed to the cap 50. The cap 50 includes two hydraulic ports 94 and 96. Port 96 communicates with upper aperture 114A, via void 102, whereas port 94 communicates via the inner tube 92 and the void 100 therein to lower aperture 114B. O-ring 108 disposed within groove 106 and O-ring 164 form pressure fluid tight seals. The rod 86 further includes land 112 having wear ring 18 and two wiping seals 116. The apertures 114A and 114B communicate with voids 110A and 110B formed between the rod 86 and inner sleeve 90. The inner sleeve 90, circumscribing the rod 86, also includes a land 120 having wear ring 124 and wiping seals 122. Outer cylinder 88, in turn, circumscribes the inner sleeve 90. The outer cylinder 88 includes outer channels 130 communicating with void 126B via aperture 128. Couple 132 communicates directly with the outer channels 130, whereas aperture 176 communicates with void 126A. Covers 178 close off the outer channels 130.

Inasmuch as high pressure hydraulic fluid is utilized to drive the cylinder 22, care must be taken to insure the fluid tight integrity of the cylinder 22. Wipers 140, 146, 156 and 162, by virtue of their wiping action along the exterior portions of central rod 86 and inner sleeve 90, continuously sweep and scrub the surfaces of dirt so as to allow smooth cylinder 22 operation. Moreover, by keeping these surfaces relatively clean, the fluid seals 144, 150, 152 and 160 are protected from damage that may cause leakage. Packing glands 170 and 172 lubricate the surface of inner sleeve 90. O-rings 142, 148, 154, 158, 164 and 168 serve as sealing gaskets.

The cylinder 22 is affixed to trunnion 72 via the threaded rings 136 on the thread 134. The cylinder 22 is inserted into trunnion 72 wherein the lower ring 136 is tightened up onto the trunnion 72 and the upper ring 136 is tightened down onto the trunnion 72.

In order to lower the rotary drive 20, high-pressure hydraulic fluid is introduced into the port 94 which communicates with the inner rod void 100 through the interior of the inner tube 92. The fluid flows through aperture 114B into void 110B and acts upon the lower portion of the sleeve 90 thereby telescoping the inner sleeve 90 downwardly. Fluid on the upper portion of the land 112 and contained within the void 110A is forced out through the aperture 114A around the inner tube 92 and towards port 96. Simultaneously, hydraulic fluid, introduced into the fluid couple 132, travels through the outer channels 130 into the void 126B through the aperture 128. The fluid expands against land 120 and the base of the outer cylinder 88 thereby forcing the outer cylinder 88 to telescope downwardly. At the same time, fluid contained on the opposing side of the land 120 in void 126A is propelled out through coupling 176. In order to retract the cylinder 22, the above steps are reversed.

By using the concentric cylinder 88/sleeve 90 arrangement, greater effective stroke distance is possible in a limited amount of space. As the inner sleeve 90 is travelling either upwardly or downwardly, the outer cylinder 88 is simultaneously travelling in the same direction as well. This design ensures the smallest possible working height in order to still obtain satisfactory drill hole depths. Moreover, precise throw distances can be achieved since it is possible to pressurize one pair of couples or ports while maintaining the other set quiescent. The cylinder 22 is double-acting having a double sleeve design. Each telescoping section also may be of the same cross-sectional area so that the same pressure is applied on all sections. The design also allows for a fixed cylinder length. In a working model, the overall length of the cylinder 22 was 104 inches (2.6 m) long. However, the cylinder 22 was able to stroke its outer cylinder 88 a total of 71¾ (1.8 m) inches. This shorter cylinder 22 length, with such a long travel, allows the overall height of the drill 10 to be only 120 inches (3 m) when set up to drill.

Figure 7:
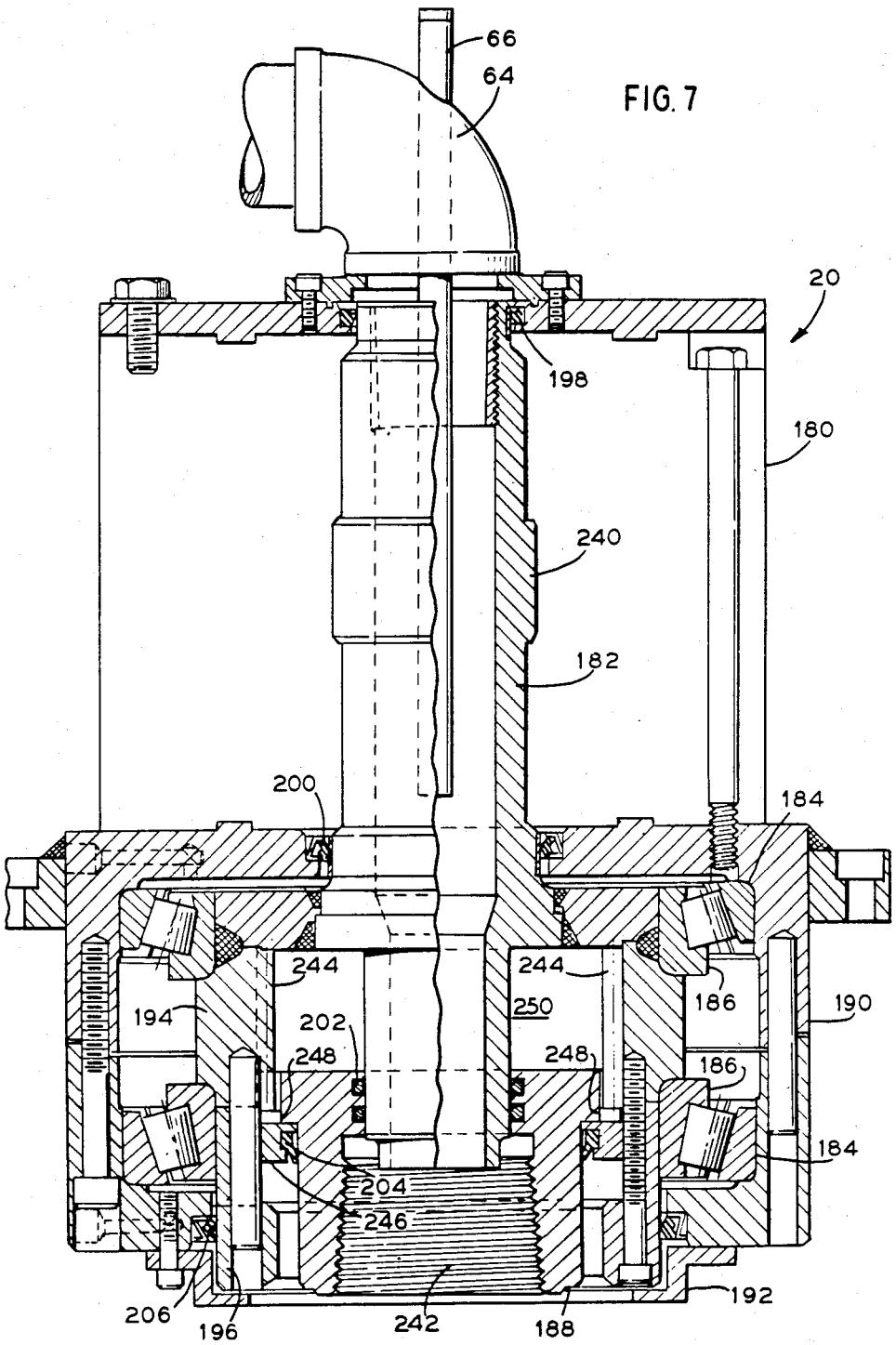
FIG. 7 is a cross-sectional view of a feature of the invention.

FIG. 7 depicts the rotary drive 20 in greater detail. The drive 20 provides rotational motion to the drill rods and drill string within the hole. A conventional hydraulic vane motor 180 (not shown in detail) is affixed to spindle 182 via spline 240. The motor 180 is is powered by hydraulic lines (not shown). The spindle 182 floats on two large bearing sets 184 and 186 selected to withstand impact loading. The motor 180 rotates the drill rods and hammer (not shown). It is also used in the making up and breaking out the drill rod joints.

Spacer 194, having splines 244, is welded to the spindle 182. Floating box 188 is fitted about the bottom of the spindle 182 and includes wings 248 registered against the splines 244. The floating box 188 is free to vertically travel within void 250 due to the cooperating sliding action between the splines 244 and the wings 248. Member 246 acts as a lower stop to prevent the box 188 from falling out of the drive 20. Threads 242 accept the drill rod. Lower splined ring 196, which rotates, accomodates a fitted wrench (not shown) to make and break the drill string joints. Rotational movement is imparted to the box 188 and hence the drill string by the mechanical contact between the splines 244 and the wings 248. Housing 190 and bottom plate 192 enclose the lower portion of the drive 20. Should the threads 242 be damaged in the box 188, it is a simple matter to remove the damaged box 188 and replace it with a new one. As a corollary, since the box 188 may be removed, quick changeover from one size of rod to another is possible, even using different threads.

In the majority of current machines, the rotary drive head consists of either a small air motor or hydraulic motor which powers the rods directly. Instead of using gears, direct drive air motors or electric motors which have problems with muck and other impurities gumming up the works, the lower portion of the drive 20 is not driven by oil or gears. Rather there are a number of seals 198, 206 and 202 which permit movement while doing away with the need for gearing. Wiper 204 keeps dirt from entering the void 250.

Elbow 64 and oil feed pipe 66 permit the introduction of water and oil through the drill rods to the hammer and drill bit. Hydraulic fluid is introduced to the motor 180 via ports (not shown) on the rotary drive 20.

Once the hole has been started and drill rods are being added to the string, a stabilizer as taught in Canadian Pat. No. 1,098,894 (or U.S. Pat. No. 4,284,154) may be inserted before the hammer which is disposed before the bit. The stabilizer will prevent the drill string from hunting within the hole which may be bored to an excess of 750 feet (229 m) at a diameter of 6½ inches (165 mm).

The drill 10 is so constructed so as to enable an operator to nip the entire device through a 24×24 inch (610 mm×610 mm) opening. The power pack skid 34 and the wheels 14 are removed, the column 16 is lowered and disassembled so as to enable the entire device to be easily moved into small stopes and drifts. Once set up, the back height or headroom requirements are minimal. As opposed to 14½ feet (4.4 m) masts, the instant invention having a 10 foot (3.1 m) height, has been successfully, used to drill the desired holes. Table 1 lists the specifications of a prototype unit.

It should be appreciated that the instant drill 10 is not limited to VRM methods. Rather the drill 10 may be utilized in any situation (below or above ground) wherein holes must be drilled.

While in accordance with the provisions of the statute, there is illustrated and described herein specific embodiments of the invention, those skilled in the art will understand that changes may be made in the form of the invention covered by the claims and that certain features of the invention may sometimes be used to advantage without a corresponding use of the other features.

TABLE I

| | | |
|---|---|---|
| DRILLING | BIT & HOLE SIZE | 5½-8 INCHES |
| CAPACITY | DEPTH | 750 FEET |
| ROTATION | TYPE | DIRECT DRIVE |
| | POWER | HYDRAULIC VANE MOTOR |
| | SPEED | 0-45 R.P.M. VARIABLE |
| | TORQUE | 5625 FT. LB. FORWARD & REVERSE |
| FEED | TYPE | DIRECT DRIVE |
| | POWER | ONE DOUBLE ACTING 3 STAGE CYLINDER |
| | TRAVEL SPEED | 0-1.2 FT./SEC. UP OR DOWN |
| | TRAVEL LENGTH | 67 INCHES |
| | HOISTING CAPACITY | 17750 LBS. MAX. |
| | HOLDBACK | 0-17750 LBS. |
| | DOWN PRESSURE | 0-19750 LBS. |
| DRILL SIZE | SIZE | 3, 3½, 4½, 5¼, 6¾, 0 × 5 FEET LONG |
| | WEIGHT | 60-130 LBS. |
| MAST | LENGTH | 104½ INCHES |
| CARRIER | TYPE | PNEUMATIC RUBBER TIRE |
| | DRIVE | 4 WHEEL INDEPENDENTLY HYDRAULICALLY DRIVEN |
| POWER SOURCE | PRIME MOVER | 25 HP AIR MOTOR OPTIONAL DIESEL OR ELECTRIC |
| | DRILLING & TRANSPORT | TWO VARIABLE PISTON PUMPS 19 G.P.M. AT 1800 R.P.M./3750 P.S.I. |
| | DRILL SET UP | ONE GEAR PUMP RATED AT 1800 R.P.M./2000 P.S.I. |
| | HYDRAULIC TANK | 100 LITER 22 GAL. CAPACITY |
| | LUBRICATOR | HIGH PRESSURE (250 P.S.I. MAX.) 3 GAL. CAPACITY |
| | WATER PUMP (NOT SHOWN) | AIR DRIVEN (10 TO 1 RATIO) |

The embodiments of the invention in which an exclusive property or privilege is claimed are defined as follows:

1. A mobile drilling apparatus, the apparatus comprising a frame, the frame having a distal end and a proximal end, a column pivotally mounted on the distal end of the frame, the column movable in a first arc substantially normal to the distal end of the frame, the first arc defined from a proximal lowered position to a distal upright vertical position, anchoring means disposed within the top of the column, a pivot assembly affixed on the distal end of the frame, a box frame mast supported by the column and affixed to the pivot assembly, the mast movable along the first arc in a fixed relationship with the column and along a second arc substantially normal to the first arc independently of the column, a concentric double acting cylinder mounted within the mast, a carrier slidably registered with the mast and ganged with the cylinder so as to move therewith, a stress relief trunnion engaging the cylinder, the stress relief trunnion mounted within a bracket disposed within the mast, the bracket affixed to the carrier, a drill motor affixed to the carrier, and means for securing the apparatus against movement.

2. The apparatus according to claim 1 wherein a threaded portion circumscribes the cylinder, a threaded ring disposed about the cylinder and engaging the threaded portion for engagement with the trunnion.

3. The apparatus according to claim 1 wherein the trunnion is affixed to the bracket as a gimbal mount, the trunnion having limited movement within the bracket to relieve stresses and loads experienced by the apparatus.

4. The apparatus according to claim 1 wherein the mast includes spaced paired roller flanges, each pair of flanges not in parallel alignment, and the carrier including a plurality of rollers meshed with the flanges, some of the rollers offset from one another.

5. The apparatus according to claim 1 including means for rotating the column through the first arc and the mast through the second arc.

6. The apparatus according to claim 5 wherein a yoke is affixed to the column, the mast communicating with the yoke to define the second arc, and means for securing the mast in any position within the second arc.

7. The apparatus according to claim 1 wherein a worktable is affixed to the mast.

8. The apparatus according to claim 1 wherein a source of power for operating the apparatus is connected to a skid detachably mounted on the proximal end of the frame.

9. The apparatus according to claim 1 wherein the pivot assembly is affixed to the lower portion of the mast and includes a second trunnion rotatable through the first arc, and means for allowing the mast to rotate through the second arc.

10. The apparatus according to claim 1 wherein the bracket includes two spaced members, a block having a bore therethrough disposed within the members, the trunnion having pins extending therefrom and pivotably supported by the blocks, a pin extending into a bore, and means for securing the blocks to the members.

* * * * *